United States Patent [19]

Honkawa

[11] 4,402,263

[45] Sep. 6, 1983

[54] AUTOMATIC INK OR WATER QUANTITY ADJUSTING DEVICE FOR PRINTING MACHINE

[75] Inventor: Yoshinori Honkawa, Fuchu, Japan

[73] Assignee: Ryobi, Ltd., Hiroshima, Japan

[21] Appl. No.: 318,098

[22] Filed: Nov. 4, 1981

[30] Foreign Application Priority Data

Nov. 7, 1980 [JP] Japan ..... 55-157427

[51] Int. Cl.[3] ..... B41F 31/12; B41F 31/26; B41F 31/34

[52] U.S. Cl. ..... 101/350; 101/365

[58] Field of Search ..... 101/348, 365, 349, 350, 101/351, 352, 357, 358, 361, 362, 363, 148, 205, 206, 207, 208, 209, DIG. 6

[56] References Cited

U.S. PATENT DOCUMENTS 1,450,269 4/1923 Walser et al. ..... 101/350

2,000,518 5/1935 Horton ..... 101/148

*Primary Examiner*—J. Reed Fisher

*Attorney, Agent, or Firm*—Sughrue, Mion, Zinn, Macpeak and Seas

[57] ABSTRACT

A transfer control roller having individually adjustable surface portions is provided between a fountain roller and a succeeding ductor roller. The surface portions can be moved radially inwardly and outwardly to vary the contact surface between the fountain roller and respective surface portions, thereby varying the amount of transferred ink or water.

8 Claims, 8 Drawing Figures

AUTOMATIC INK OR WATER QUANTITY ADJUSTING DEVICE FOR PRINTING MACHINE

BACKGROUND OF THE INVENTION

This invention relates to an automatic ink or water quantity adjusting device for an offset press, which automatically adjusts the quantity of ink or water applied to a surface of a printing plate on a plate cylinder.

In general, in an off-set press, ink or water is applied to the surface of a printing plate on the plate cylinder through the fountain roller, the ductor roller and a further group of rollers in the stated order, and printing is correctly carried out by adjusting to a suitable value the quantity of ink or water which is transferred.

Examples of a conventional ink (or water) quantity adjusting device are as shown in FIGS. 1 and 2. For convenience these conventional devices, and the invention which follows, will be described in the context of ink application only, although it should be kept in mind that they are applicable to other fluid transfers such as water.

In the device shown in FIG. 1, a plurality of blades b are moved toward or away from the outer wall of a fountain roller a by an electric motor so that the clearance c therebetween is varied. In the device shown in FIG. 2, the clearance c is adjusted by turning an electric roller d which is in contact with the fountain roller a. That is, in both of the devices, the clearance c is adjusted as required to control the quantity of ink e which adheres to the fountain roller a.

However, these conventional devices are disadvantageous in that small adjustments in clearance will have a large effect on the quantity of ink transferred and on the density of ink on the resulting print. Since it is considerably intricate and difficult to finely adjust the clearance it is extremely difficult to finely adjust the quantity of transferred ink and the print density is often unsatisfactory.

SUMMARY OF THE INVENTION

Accordingly, it is an object of this invention to provide an ink transfer adjusting device which can easily and automatically provide the correct amount of ink transfer.

Briefly, this is achieved by an automatic ink or water quantity adjusting device according to this invention which is provided with a transfer control roller having a plurality of arcuate movable blocks which are movable radially about fulcrum shafts. The transfer control roller is rotatably supported by frames in such a manner that it is in contact with a fountain roller and a ductor roller and is operated in association with the fountain roller, with each movable block being moved radially through an adjusting roll by an adjusting mechanism having a motor which is operated on and off in response to an ink or water quantity dectection signal from a printing machine, so that the length of the ink or water carrying surface of the movable block is finely adjusted to thereby adjust the quantity of ink or water to be supplied to the ductor roller. Since the ink or water sticking surface of each movable block can be finely adjusted as described above, the quantity of ink or water can be finely adjusted in conformance to densities required. Thus, the ink densities on a print can be stabilized according to this invention.

DETAILED DESCRIPTION OF THE PREFERRED EMBODIMENTS

One embodiment of this invention will now be described with reference to an automatic ink quantity adjusting device shown in FIGS. 3 through 6.

Figure 1:
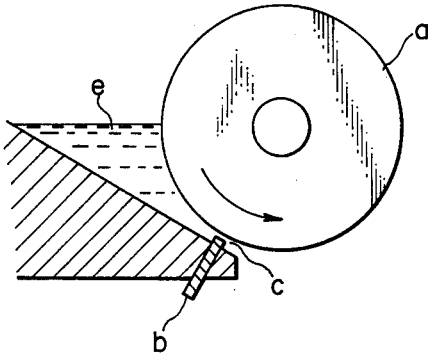
FIGS. 1 and 2 are sectional views showing examples of conventional ink (or water) quantity adjusting devices.
Figure 2:
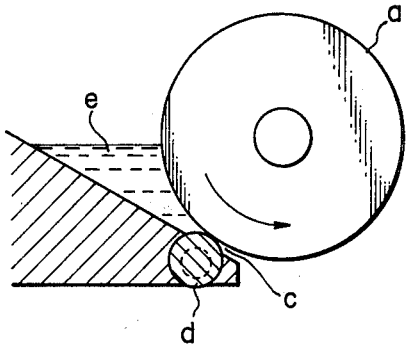
Figure 3:
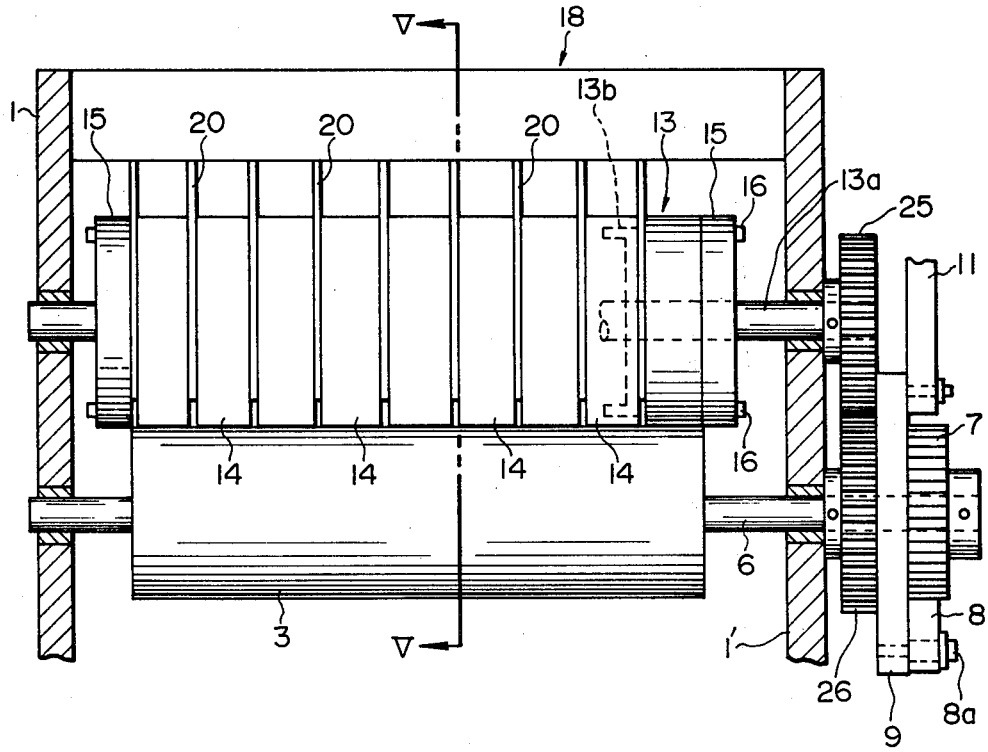
FIG. 3 is a longitudinal front view showing an automatic ink (or water) quantity adjusting device for a printing machine, according to this invention.
Figure 4:
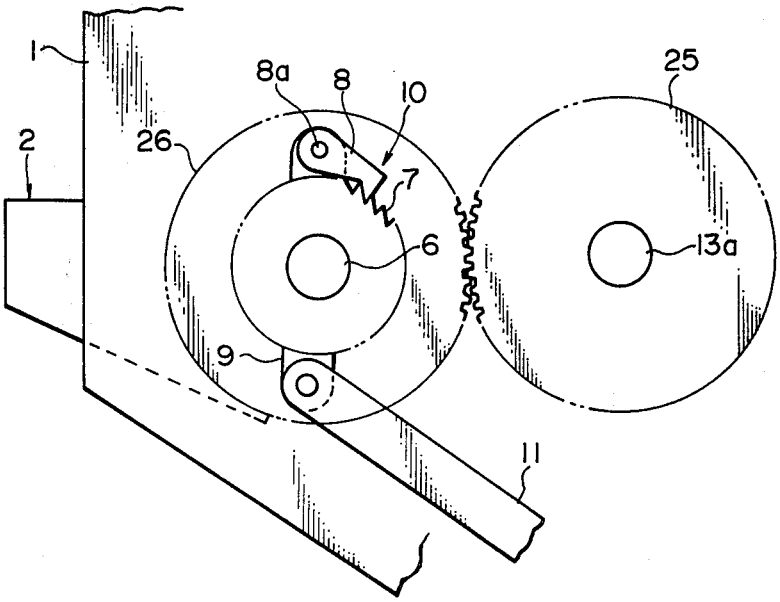
FIG. 4 is a side view showing a part of a drive system in the device shown in FIG. 3.
Figure 5:
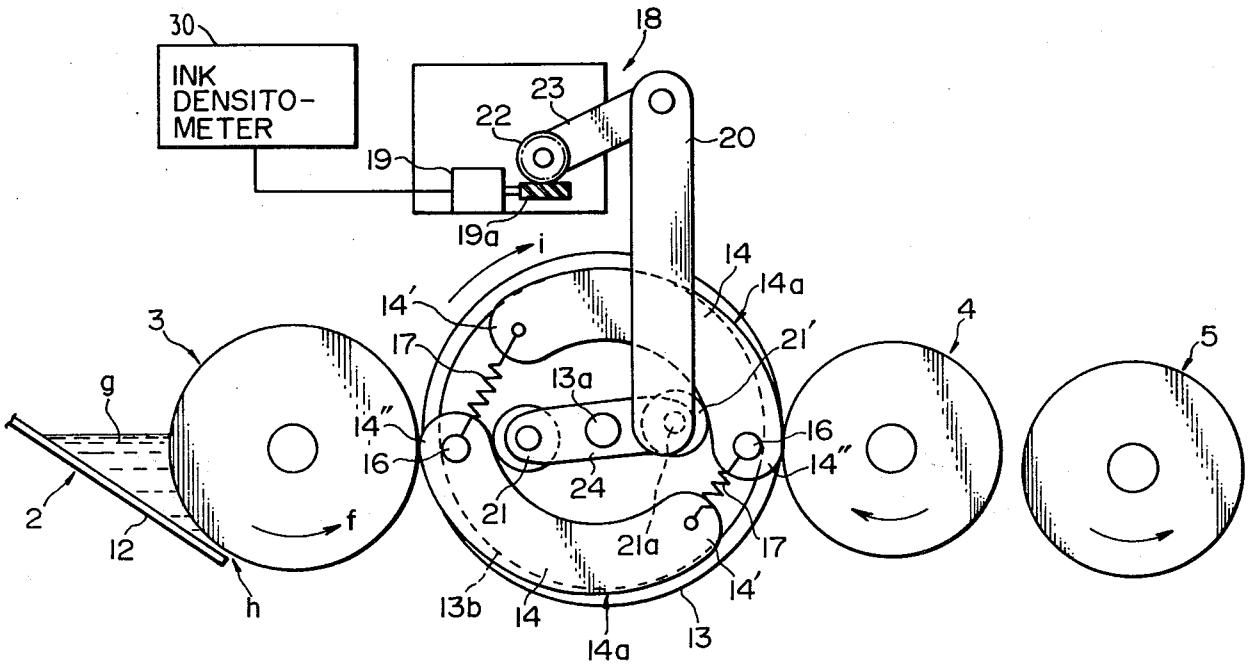
FIG. 5 is a sectional view taken along line V—V in FIG. 3.

As shown in FIGS. 3 through 5, an ink fountain roller 3, an ink ductor roller 4 and ink rollers 5 are rotatably supported between frames 1 and 1' in the stated order from an ink fountain 2 towards a plate cylinder (not shown). A ratchet 7 is fixedly mounted on the outer end portion of the shaft 6 of the ink fountain roller 3 which is extended through the frame 1'. A pawl 8 pivotally mounted on a rod 8*a* is provided on a feed plate 9. The feed plate is loosedly fitted on the outer end portion of the shaft 6. The pawl 8 is engaged with the ratchet 7 to form a ratchet mechanism 10 (see FIG. 4). The feed plate 9 is coupled through a lever 11 to the drive section of a printing machine (not shown). When the printing machine is started, the ink fountain roller 3 is turned in the direction of the arrow f in FIG. 5 by the ratchet mechanism 10, so that the ink g in the ink fountain 2 will be carried on the outer wall of the ink fountain roller 3. The amount of ink carried by the ink fountain roller 3 is controlled by adjusting the position of an ink blade 12 provided for the ink fountain, i.e. by adjusting the clearance h between the ink blade 12 and the ink fountain roller 3 as desired.

An ink adjusting roller 13 is rotatably supported between the frames 1 and 1' in such a manner that it is between and in contact with both the ink fountain roller 3 and the ink ductor roller 4. Gears 25 and 26 are fixedly mounted on the shaft 13*a* of the ink adjusting roller 13 and the shaft 6 of the ink fountain roller 3, respectively, and the gears 25 and 26 are engaged with each other. Therefore, when the printing machine is driven, the ink adjusting roller 13 is turned in the direction of the arrow i in FIG. 5.

The ink adjusting roller 13 comprises a plurality of movable blocks 14 which are substantially arcuate as viewed from the front.

More specifically, a plurality of pairs of movable blocks 14 are provided. Each pair of movable blocks 14 are symmetrically arranged with their longer arcs set outside as shown in FIG. 5. Disk-shaped blocks 15 and 15 are fixedly mounted on the shaft 13*a* in such a manner that they are spaced a predetermined distance from each other, each block carrying a pair of fulcrum shafts 16. For each block pair except the right-most pair in FIG. 3, a plate 13*b* is provided which is keyed to and rotatable with the shaft 13*a*. Each plate carries a pair of fulcrum shafts 16. First end portions of the movable blocks 14 of each block pair are rotatably mounted on the fulcrum shafts 16, so that the movable blocks 14 and 14 can swing radially about the fulcrum shafts. The movable end portions 14' and 14' of the movable blocks 14 and 14 of each pair are coupled through tension springs 17 and 17 to the fulcrum shafts 16 and 16, respectively, so that the movable end portions 14' and 14' are normally pulled towards the first end portions, i.e. toward the pivotal end portions 14'' and 14'' of the opposed movable blocks 14 and 14. Thus, the movable end portions 14' of all of the movable blocks 14 are normally pulled towards the center by the tension springs 17.

It should be noted that the pivotal end portions 14'' of the movable blocks 14 are mounted on the shafts 16 as follows: The movable blocks 14 are so positioned that, even when the movable end portions 14' are pulled towards the center, the outer surface of the pivotal end portions 14'' of each movable block 14, i.e., an ink sticking surface **14*a* which is the longer arcuate surface of the movable block 14, can contact with the ink fountain roller 3 and the ink ductor roller 4**.

An adjusting mechanism 18 having a motor 19 which is operated on and off according to an ink quantity detection signal from the printing machine, a link 20 and an adjusting rolls 21, 21 are provided to radially move each movable block pair.

Each adjusting mechanism 18, as shown in FIG. 5, comprises: the motor 19; a worm gear **19*a* on the shaft of the motor 19; a gear wheel 22 engaged with the worm 19*a* ; and an arm 23 cooperating with the gear wheel 22. The movable end portions of the arms 23 are rotatably coupled to the end portions of the links 20. Each adjusting roll 21, 21 is rotatably mounted on an end portion of an arm 24 the middle of which is loosely fitted on the shaft 13*a*. One of the ends of the arm 24 is pivotally coupled to the other end of the link 20. I.e., as viewed in FIG. 5, the rollers 21 and 21 are both mounted on the far side of arm 24 at either end thereof, while the shaft 21*a* for mounting the other roller 21 extends through the arm 24 to the rear side thereof where it is rotatably coupled to the lower end of link 20. Thus, the rolls 21, 21 are coupled through the arm 24 and the link 20 to the adjusting mechanism 18**.

When the motor 19 is rotated in a direction so that the link 20 is moved upwardly in FIG. 5 through the arm 23, the arm 24 is turned counterclockwise, and accordingly the adjusting roll 21 in contact with the inner surface of the pivotal end portion of the movable block 14 is turned counterclockwise. As a result, the movable block 14 is moved radially outwardly against the elastic force of the tension spring 17 so that the contact length between the ink sticking surface **14*a* and the ink fountain roller 3** is increased. The upper arcuate member is similarly moved.

The above-described adjusting mechanism 18 is provided for every movable block 14. An ink densitometer of a well-known type, shown schematically at 30, adapted to detect ink densities at various points on a printing machine, outputs ink density detection signals as to various points on a print. In response to the detection signals the motors 19 of the adjusting mechanisms 18 are rotated in the forward direction or in the reverse direction, so that the movable blocks 14 are suitably moved as was described above, to increase or decrease the contact length of the ink sticking surfaces **14*a*, whereby the quantity of ink to be supplied from the ink fountain roller 3 to the ink ductor roller 4**, i.e. the quantities of ink to be supplied to printing plates on the plate cylinder, are set to predetermined values. Thus, the ink densities of the printing plate can be suitably adjusted.

Figure 6A:
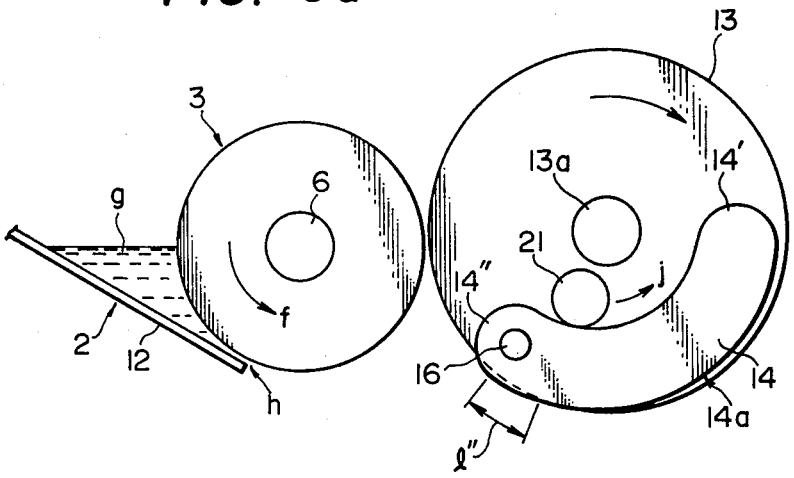
FIGS. 6(*a*)–6(*c*) are explanatory diagrams for a description of the operation of the essential components of the device according to the invention.
Figure 6B:
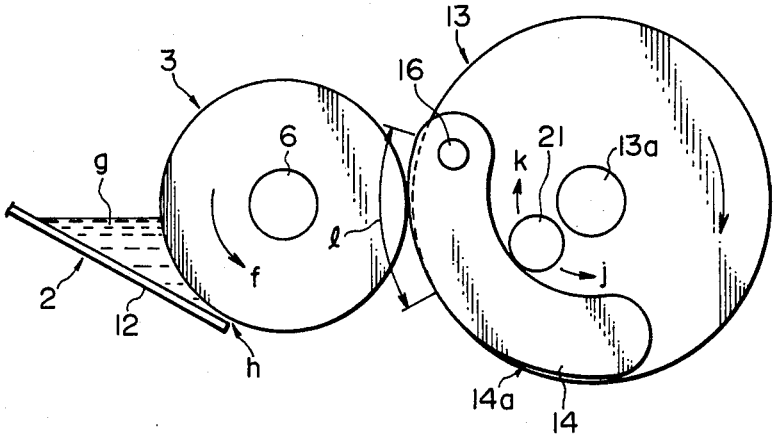
Figure 6C:
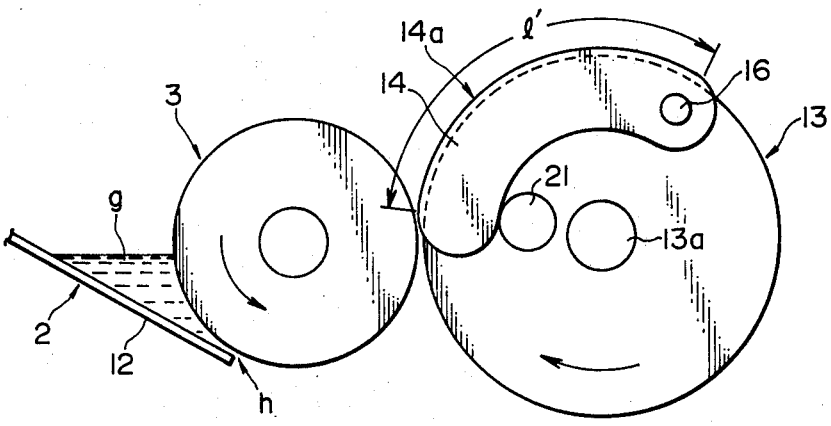

With the above-described arrangement, an automatic ink quantity adjusting operation is carried out as follows:

When a printing machine (not shown) starts, the ink fountain roller 3 is turned by the ratchet mechanism 10, while the ink adjusting roller 13 is also turned through the gears 25 and 26. As shown in FIGS. 6(*a*)–6(*c*), depending on the positions of the adjusting rolls 21, the movable blocks 14 are displaced radially, and accordingly the contact lengths between the ink fountain roller 3 and the ink sticking surfaces **14*a* are changed, with the result that the quantities of ink carried to the ductor roller 4 by the ink sticking surfaces 14*a*** are changed.

A plurality of ink densitometers detect ink densities from a print sheet surface, and the ink densities thus detected are compared with predetermined values. When the quantity of ink in a particular print region is found to be low, for instance, then the motor 19 of the respective adjusting mechanism 18 is operated in response to a signal representing the fact that the ink quantity is too low. As a result, the adjusting roll 21 is moved in the direction of the arrow j as shown in FIGS. 6(*a*) and 6(*b*) to move the movable block 14 outwardly, so that the contact length between the ink sticking surface **14*a* and the ink fountain roller 3** is increased.

When, on the other hand, the quantity of ink is detected to be too much, the motor 19 is turned so as to move the adjusting roll 21 in the direction of the arrow k in FIG. 6(*b*). In this operation, the movable block 14 is pulled towards the center by the tension spring 17, so that the contact surface between the ink sticking surface **14*a* and the ink fountain roller 3** is decreased.

It is assumed that, when the adjusting roll 21 is positioned at the middle of the movable block 14 as shown in FIG. 6(*b*), the contact length between the ink sticking surface **14*a* and the ink fountain roller 3 is represented by l. If, under this condition, the adjusting roll 21 is moved in the direction of the arrow j in FIG. 6**(*b*), then the movable block 14 is moved radially outwardly as shown in FIG. 6(*c*), as a result of which the contact length l is increased to l'. If, on the other hand, the adjusting roll 21 is moved in the direction of the arrow k in FIG. 6(*b*), then the movable block 14 is moved radially inwardly as shown in FIG. 6(*a*), as a result of which the contact length l is decreased to l''. Thus, in the former case, the quantity of ink sticking on the ink sticking surface is increased; and in the latter case, the quantity of ink is decreased. That is, the quantity of ink supplied to the ink ductor roller 4 is adjusted.

As was described above, a plurality of ink densitometers detect ink densities at various points on a print to provide the ink density detection signals. In response to the ink density detection signals, the adjusting mechanisms 18 operate to suitably move their respective movable blocks. Therefore, the quantities of ink at various points on the print can be individually adjusted.

After the clearance h between the ink fountain roller 3 and the ink blade 12 has been adjusted to coarsely control the quantity of ink sticking onto the ink fountain roller 3, the movable blocks 14 are finely adjusted. Therefore, the quantity of ink can be accurately adjusted.

The embodiment of this invention has been described with reference to an ink quantity adjusting device; however, the technical concept of the invention can equivalently applied to a water quantity adjusting device.

As is apparent from the above description, in the ink (or water) quantity adjusting device according to this invention, the adjusting roll 13, which is rotatably supported in such a manner that it is in contact with the fountain roller 3 and the ductor roller 4 is operated to move its respective movable blocks 14 radially, so that the contact lengths of the ink sticking surfaces with the fountain roller 3 are adjusted as desired, whereby the quantities of transferred ink are finely adjusted. Therefore, with the ink (or water) water quantity adjusting device of this invention, unlike the conventional one which adjusts the quantity of ink (or water) by controlling the clearance only, the quantity of ink (or water) can be delicately controlled even if ink (or water) of a differend density is used. Therefore, by finely adjusting the quantities of ink with the movable blocks 14 after the total quantity of ink to be supplied to the fountain roller 13 has been adjusted with the blade 12, the quantities of ink can be finely adjusted in conformance to predetermined ink densities on a print sheet surface.

The adjusting roller 13 is made up of the plurality of movable blocks 14. The movable blocks 14 are moved radially by the adjusting mechanisms 18 which operate in response to the detection signals outputted by the ink densitometers adapted to detect ink densities at various points on a print sheet surface, so that each movable block 14 adjusts the quantity of ink which is suitable for the respective point on the print sheet surface. Therefore, the fine adjustment is effected uniformly over the entire print sheet surface, and the print surface is of uniform ink density.

What is claimed is:

1. In a printing machine of the type wherein a fluid is transferred to a printing means from a fountain roller via at least one other roller, an automatic fluid quantity adjusting device comprising:

a transfer control roller for transferring said fluid from said fountain roller to said other roller, said transfer control roller comprising movable means having a contact surface, said movable means contacting said fountain roller over said contact surface, said movable means comprising at least one arcuate member having an outer curved surface and being pivotally mounted near one end; and control means for moving and pivoting said arcuate member to change the amount of said outer curved surface which contacts said fountain roller to change the amount of fluid transferred to said other roller.

2. An automatic fluid quantity adjusting device as claimed in claim 1, wherein said movable means comprises a plurality of arcuate members and wherein said control means comprises a plurality of control mechanisms for independently adjusting said arcuate members.

3. An automatic fluid quantity adjusting device as claimed in claim 2, wherein said arcuate members are arranged in opposed pairs with each pair being moved by a respective control mechanism.

4. An automatic fluid quantity adjusting device as claimed in claim 3, wherein each said respective control mechanism comprises:

an arm having first and second ends each for contacting a different one of said arcuate members, said arm being pivotally mounted at a point intermediate said first and second ends;

a link member having one end coupled to said arm at a point on said arm spaced from said intermediate point; and means for providing reciprocating motion to said link member to pivot said arm whereby said arcuate members are urged outwardly by said first and second ends of said arm.

5. An automatic fluid quantity adjusting device as claimed in claim 4, wherein said means for providing reciprocating motion comprises an electric motor which provides an amount of reciprocating motion in accordance with a control signal, said device further comprising detection means for detecting the density of ink in various regions on a resulting print and providing separate control signals to each control mechanism in accordance with the detected ink densities in respective regions.

6. An automatic fluid quantity adjusting device as claimed in claim 4, further comprising bias means for biasing the end of each arcuate member other than said one end out of contact with said fountain roller.

7. An automatic fluid quantity adjusting device as claimed in claim 1, wherein said fluid is ink.

8. An automatic fluid quantity adjusting device as claimed in claim 1, wherein said fluid is water.

* * * * *